US009227228B2

(12) United States Patent
Kim et al.

(10) Patent No.: US 9,227,228 B2
(45) Date of Patent: Jan. 5, 2016

(54) MAIL SORTING SYSTEM

(71) Applicant: Electronics and Telecommunications Research Institute, Daejeon (KR)

(72) Inventors: Ki Hak Kim, Cheongju-si (KR); Sung Woo Jun, Daejeon (KR); Jong Heung Park, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 282 days.

(21) Appl. No.: 13/900,710

(22) Filed: May 23, 2013

(65) Prior Publication Data

US 2014/0091015 A1 Apr. 3, 2014

(30) Foreign Application Priority Data

Sep. 28, 2012 (KR) ..... 10-2012-0109322

(51) Int. Cl.
*B07C 5/00* (2006.01)
*B07C 3/02* (2006.01)

(52) U.S. Cl.
CPC .... *B07C 5/00* (2013.01); *B07C 3/02* (2013.01)

(58) Field of Classification Search
CPC ..... B07C 5/00; B07C 3/06; B07C 1/14; B07C 5/3412
USPC ..... 209/552, 584, 900
See application file for complete search history.

(56) References Cited

U.S. PATENT DOCUMENTS

| | | | | |
|---|---|---|---|---|
| 5,588,520 | A * | 12/1996 | Affaticati et al. | 198/370.06 |
| 6,275,000 | B1 * | 8/2001 | Nishimura | 318/811 |
| 8,100,058 | B2 * | 1/2012 | Austin | 104/48 |
| 8,919,570 | B2 * | 12/2014 | DeWitt et al. | 209/655 |
| 2008/0156875 | A1 * | 7/2008 | Kinoshita et al. | 235/449 |
| 2009/0214357 | A1 * | 8/2009 | Galley | 417/44.1 |

FOREIGN PATENT DOCUMENTS

KR 10-0722572 B1 6/2007

* cited by examiner

*Primary Examiner* — Terrell Matthews
(74) *Attorney, Agent, or Firm* — LRK Patent Law Firm

(57) ABSTRACT

Provided is a mail sorting system including: a detection unit configured to output a detection signal for a length of a mail inserted to a conveyor belt; a crossbelt driving unit configured to control a motor interworking with a crossbelt including a central region and first and second lateral regions adjacent to both sides based on the central region where the mail is moved and arranged from the conveyor belt; and a control unit configured to transmit a motor control signal which controls at least one of an rpm and a rotational speed of the motor so that the mail is arranged on any one of the central region and the first and second lateral regions based on the detection signal, to the crossbelt driving unit, in order to easily discharge the mail from a destination discharge point by disposing the inserted mail at a setting region of the crossbelt.

14 Claims, 6 Drawing Sheets

MAIL SORTING SYSTEM

CROSS-REFERENCE TO RELATED APPLICATIONS

This application claims priority to and the benefit of Korean Patent Application No. 10-2012-0109322 filed in the Korean Intellectual Property Office on Sep. 28, 2012, the entire contents of which are incorporated herein by reference.

TECHNICAL FIELD

The present invention relates to a mail sorting system, and more particularly, to a mail sorting system which facilitates discharge of a mail at a destination discharge point by placing the inserted mail at a setting region of a crossbelt.

BACKGROUND

As a parcel quantity is increased with the growth of a parcel delivery service industry, the parcel quantity has increased every year. As a result, a mail center or a distribution center uses a mail sorting system in order to efficiently classify mails.

In recent years, new sorting apparatuses such as a crossbelt type, an E-Tray type, and the like have been developed and commercialized, in order to increase a processing capacity of the mail, and developed to sort small-sized mails to large-sized mails. However, when a mail which falls to a sorting hole chute is large and heavy, the corresponding mail may frequently damage the small-sized mail first sorted and loaded on the sorting hole chute.

In order to solve the problem, a method of attaching a rubber-made tape to the bottom of the sorting hole chute or reducing a drop speed of a heavy parcel by installing a roller applied with power has been used. However, in the case of the rubber-made tape, there is inconvenience that the rubber-made tape itself is worn out and thus needs to be attached again and in the case of the roller applied with the power, there is a disadvantage in that energy is wasted.

SUMMARY

An exemplary embodiment of the present invention has been made in an effort to provide a mail sorting system that which facilitates discharge of a mail from a destination discharge point by placing the inserted mail at a setting region of a crossbelt.

An exemplary embodiment of the present invention provides a mail sorting system, including: a detection unit configured to output a detection signal for a length of a mail inserted to a conveyor belt; a crossbelt driving unit configured to control a motor interworking with a crossbelt including a central region and first and second lateral regions adjacent to both sides based on the central region where the mail is moved and arranged from the conveyor belt; and a control unit configured to transmit a motor control signal which controls at least one of an rpm and a rotational speed of the motor so that the mail is arranged on any one of the central region and the first and second lateral regions based on the detection signal, to the crossbelt driving unit.

According to an exemplary embodiment, a mail sorting system has an advantage that facilitates discharge of a mail by controlling at least one of an rpm and a rotational speed of a motor which interworks with a crossbelt so as to place the mail at any one region of a central region and first and second lateral regions of the crossbelt based on at least one of the length of the mail and destination information.

Further, in the mail sorting system according to the exemplary embodiment, when a plurality of mails having the same destination information is inserted, the plurality of mails is classified into small-sized mails, medium-sized mails, and large-sized mails in accordance with the lengths of the respective mails to be discharged to different destination outlets in accordance with the classified lengths. Therefore, the mails can be easily separated for each size to thereby improve working efficiency.

In the mail sorting system according to the exemplary embodiment, the large-sized long mails are first discharged and thereafter, the small-sized short mails are discharged later to thereby prevent the small-sized short mails from being distorted and damaged.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
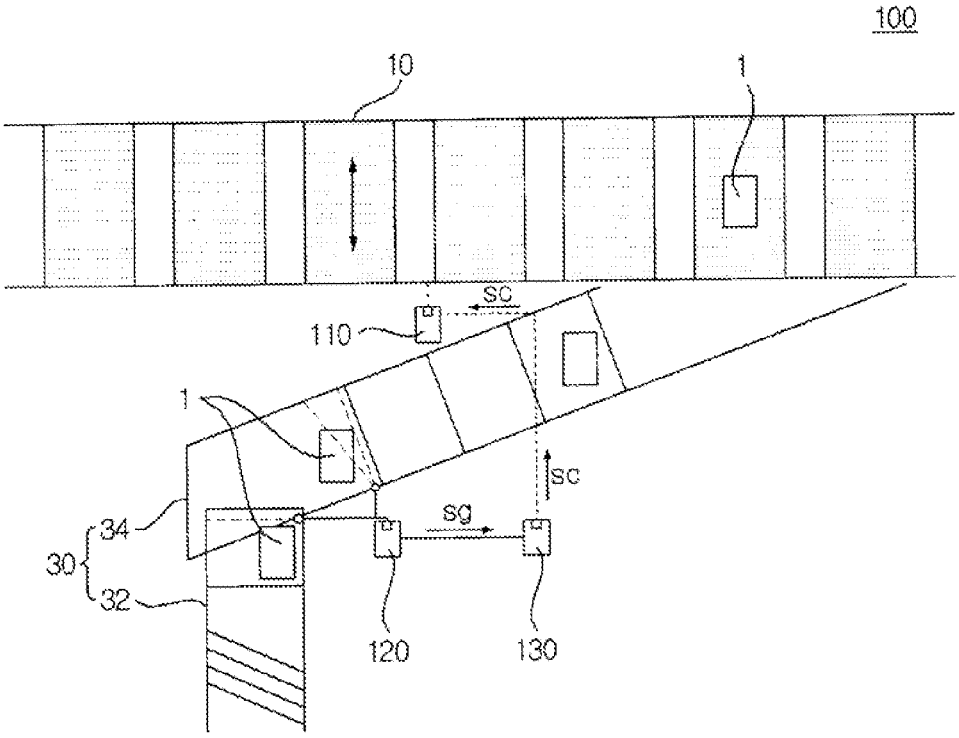
FIG. 1 is a system diagram schematically illustrating a mail sorting system according to an exemplary embodiment.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings.

In describing components of an exemplary embodiment, different reference numerals may refer to components with the same name depending on the drawings and the same reference numeral may refer to the components with the same name in different drawings. However, even in this case, it means that corresponding components have different functions according to an exemplary embodiment or it does not mean that the corresponding components do not have the same functions in different exemplary embodiments, and functions of the respective components will be determined based on a description of the respective components in the corresponding exemplary embodiment.

In describing the exemplary embodiment, when it is determined that the detailed description of the known configuration or function related to the present invention may obscure the gist of the present invention, the detailed description thereof will be omitted.

In describing the components of the exemplary embodiment, terms such as first, second, A, B, (a), (b), and the like may be used. The terms are used to just distinguish the component from other components and the essence, sequence, or order of the corresponding component is not limited to the terms. When it is disclosed that any component is "connected", "coupled", or "linked" to other components, it should be understood that the component may be directly connected or linked to other components, but another component may be "connected", "coupled", or "linked" between the respective components. Hereinafter, parts required to understand an operation and an action of a mail sorting system according to an exemplary embodiment will be described in detail with reference to the accompanying drawings.

FIG. 1 is a system diagram schematically illustrating a mail sorting system according to an exemplary embodiment.

Referring to FIG. 1, a mail sorting system 100 may include a crossbelt 10 configured to convey a mail 1 up to a corresponding destination sorting position, a motor 20 configured to interwork with the crossbelt 10, a crossbelt driving unit 110 configured to drive the motor 20, a detection unit 120 disposed in a conveyor belt 30 moving the mail 1 provided from the outside to the crossbelt 10 to output a detection signal sg which corresponds to at least one of the length and a lateral position of the mail 1, and a control unit 130 configured to transfer a motor control signal sc including at least one of a rotational speed and an rpm of a motor (not illustrated) to the crossbelt driving unit 110 so as to move the mail 1 to any one of a central region on the crossbelt 10 and first and second lateral regions adjacent to both sides based on the central region, based on the detection signal sg.

In this case, the crossbelt driving unit 110 may move and arrange the mail 1 moved by the conveyor belt 30 to and on any one of the central region on the crossbelt 10 and the first and second lateral regions adjacent to both sides based on the central region by controlling at least one of the rotational speed and the rpm of the motor, based on the motor control signal sc.

That is, the crossbelt driving unit 110 may include information on the motor control signal sc, that is, information on at least one of the rotational speed and the rpm of the motor, and receive the motor control signal sc through wired and wireless communication with the control unit 130.

In other words, the control unit 130 may include a communication module (not illustrated) including a transmitting/receiving device, and the crossbelt driving unit 110 may include a driving communication module (not illustrated) that may receive the motor control signal sc transmitted from the communication module and transmit information on a current state of the motor to the communication module, but the present invention is not limited thereto.

That is, the crossbelt driving unit 110 may move and arrange the mail 1 to and on any one of the central region on the crossbelt 10 and the first and second lateral regions adjacent to both sides based on the central region of the crossbelt 10 by controlling a movement speed and a movement length of the crossbelt 10 that interworks with the motor, by controlling at least one of the rotational speed and the rpm of the motor.

Herein, the detection unit 120 is disposed in the conveyor belt 30 including a first conveyor belt 32 into which the mail 1 is inserted from the outside, and a second conveyor belt 34 disposed between the first conveyor belt 32 and the crossbelt 10 to move the mail 1 moved on the first conveyor belt 32 to the crossbelt 10, so as to detect the detections signal sg from a plurality of sensors (not illustrated) to correspond to at least one of the length and the lateral position of the mail 1.

Herein, the plurality of sensors will be described below.

Figure 2:
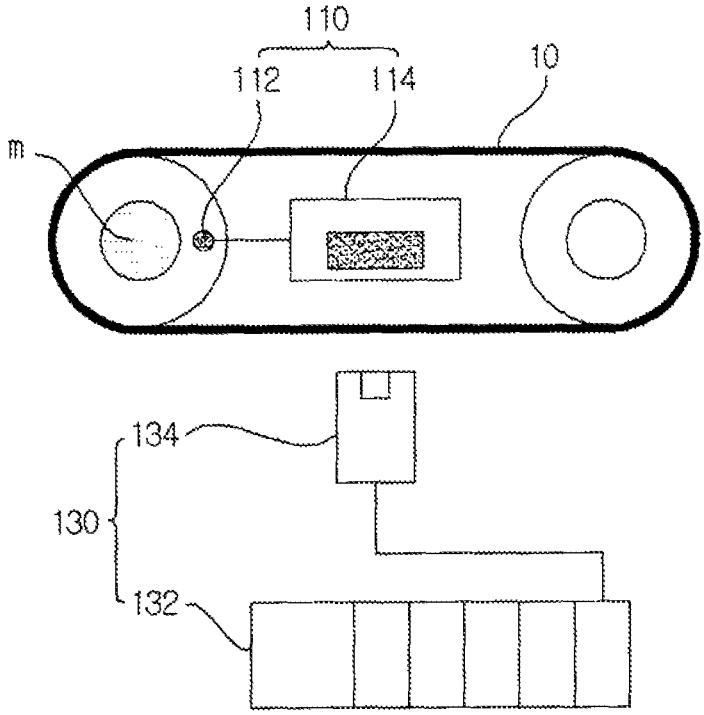
FIG. 2 is a cross-sectional view schematically illustrating a cross section of the mail sorting system illustrated in FIG. 1.

The control unit 130 generates the motor control signal sc based on the detection signal sg, and transmits and transfers the generated motor control signal sc to the crossbelt driving unit 110 to control the crossbelt 10. FIG. 2 is a cross-sectional view schematically illustrating a cross section of the mail sorting system illustrated in FIG. 1, and FIG. 3 is a control block diagram illustrating a control configuration for the mail sorting system according to the exemplary embodiment.

Figure 3:
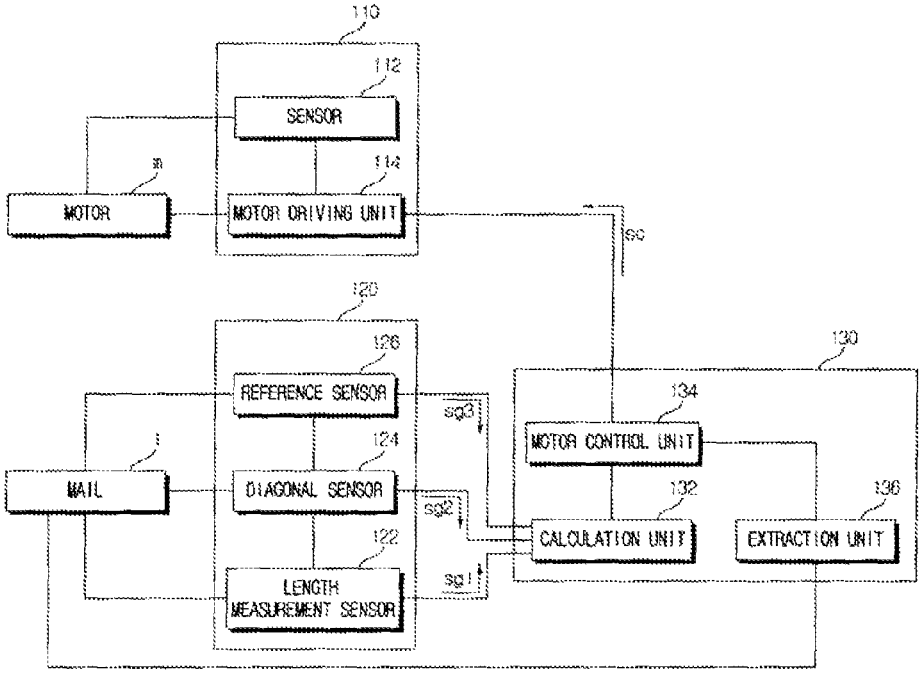
FIG. 3 is a control block diagram illustrating a control configuration for the mail sorting system according to the exemplary embodiment.

FIGS. 2 and 3 will be described by using reference numerals illustrated in FIG. 1.

Referring to FIGS. 2 and 3, the mail sorting system 100 may include the crossbelt driving unit 110, the detection unit 120, and the control unit 130.

In this case, the crossbelt driving unit 110 may include a sensor 112 configured to sense a motor rpm of a motor m and a motor driving unit 114 configured to drive and control the motor m based on the motor control signal sc transmitted from the control unit 130.

In the exemplary embodiment, the motor control signal sc is transmitted to the motor driving unit 114, and the motor driving unit 114 may include the driving communication module as described above, but the present invention is not limited thereto.

That is, the sensor 112 senses at least one of the rotational speed and the rpm of the motor m to transmit at least sensed one to the motor driving unit 114.

In this case, the motor driving unit 114 drives the motor m in accordance with at least one of the rotational speed and the rpm of the motor m which are set, based on the motor control signal sc and compares at least set one with at least one of the rotational speed and the rpm of the motor m which are sensed by the sensor 112 to reset the set one when a comparison error occurs.

That is, the motor driving unit 114 compares an ideal rotational speed and an ideal rpm of the motor m with an actual rotational speed and an actual rpm sensed by the sensor 112 to reduce an error range, but the present invention is not limited thereto.

The detection unit 120 may include a length measurement sensor 122 configured to output a first detection signal sg1 included in the detection signal sg corresponding to the length of the mail 1 moved from the first conveyor belt 32, a diagonal sensor 124 which is disposed on the second conveyor belt 34, forms a first angle based on one lateral surface of the mail 1, and outputs a second detection signal sg2 which is included in the detection signal sg corresponding to the lateral surface of the mail 1, and a reference sensor 126 which forms a second angle different from the first angle based on a corner (edge) of the mail 1 and detects a third detection signal sg 3 among detection signals sg corresponding to the mail 1.

Herein, the length measurement sensor 122 is disposed at an end side of the first conveyor belt 32 to output the first detection signal sg1 including a detection start timing and a detection end timing of the mail 1 moved to the first conveyor belt 32.

That is, the first detection signal sg1 may be, for example, a kind of a dc signal which may have a predetermined voltage level at the detection start timing of the mail 1 and a ground voltage level at the detection end timing.

The diagonal sensor 124 is disposed on the second conveyor belt 34, forms the first angle based on one lateral surface of the mail 1 moved from the first conveyor belt 32, and outputs the second detection signal sg2 which detects the lateral surface of the mail 1.

In addition, the reference sensor 126 is adjacent to the diagonal sensor 124 and may output a third detection signal sg3 which detects the corner of the mail 1 to the one lateral surface at the second angle different from the first angle.

The control unit 130 may include a calculation unit 132 configured to calculate the length and the lateral position of the mail based on the detection signals sg when the detection signals sg including the first, second, and third detection signals sg1, sg2, and sg3 are input from the detection unit 120, and a motor control unit 134 configured to transmit the motor control signal sc to the crossbelt driving unit 110 by determining at least one of the rpm and the rotation speed of the motor m which are set in accordance with the length and the lateral position of the mail 1 which are calculated by the calculation unit 132. In this case, the calculation unit 132 may calculate the length of the mail 1 based on a time difference between the detection start timing and the detection end timing of the first detection signal sg1, and the speed of the first conveyor belt 32.

Further, the calculation unit 132 may calculate the lateral position of the mail 1 by using the second and third detection signals sg2 and sg3, and an angle difference between the diagonal sensor 124 and the reference sensor 126, that is, the first and second angles and the time difference.

The motor control unit 134 may generate the motor control signal sc for at least one of the rotational speed and the rpm of the motor m based on the length and the lateral position of the mail 1 calculated by the calculation unit 132 to transmit the generated motor control signal sc to the crossbelt driving unit 110.

That is, the motor control unit 134 may transfer the motor control signal sc to the crossbelt driving unit 110 by determining the rotational speed and the rpm of the motor m, based on at least one of the length and the lateral position of the mail 1, and a total length of the crossbelt 10 and a movement length of the crossbelt 10 depending on the rpm of the motor m which are set.

For example, in the case where the sensor 112 included in the crossbelt driving unit 110 sets the crossbelt 10 to move by 20 mm when the motor m makes one rotation, when it is assumed that the length of the mail 1 is 500 mm, the control unit 130 may transmit the motor control signal sc including at least one of the rotational speed and the rpm to the crossbelt driving unit 110 so that the motor m rotates with a value acquired by dividing 950 mm by 20 mm so as to move and arrange the mail 1 to and at the central position of the crossbelt 10 only when the movement length of the crossbelt 10 is 950 mm when the mail 1 is moved to the crossbelt 10.

Herein, the control unit 130 may determine a movement start timing of the crossbelt 10 in accordance with the lateral position of the mail 1, and the movement start timing may be associated with at least one of the rotational speed and the rpm of the motor control signal sc.

Further, the control unit 130 may transmit the motor control signal sc to the crossbelt driving unit 110 so that the mail 1 is moved and arranged to and on the central region of the crossbelt 10 when the mail 1 arranged on the conveyor belt 30 is moved and arranged to and on the crossbelt 10, during an automatic mode operation according to a command inputted from the outside.

Thereafter, the control unit 130 may include an extraction unit 136 configured to extract destination information of the mail 1 when the mail 1 is arranged on the central region of the crossbelt 10.

Here, the extraction unit 136 may be a reader extracting a barcode or address information attached to the mail 1, and is not limited to a kind of the reader.

In this case, when the destination information is inputted from the extraction unit 136, the control unit 130 may generate the motor control signal sc and transmit the generated motor control signal sc to the crossbelt driving unit 110 so as to move the mail 1 arranged on the central region of the crossbelt 10 to any one of the first and second lateral regions of the crossbelt 10 adjacent to a destination outlet corresponding to the destination information.

Further, the control unit 130 may generate the motor control signal sc and transmit the generated motor control signal sc to the crossbelt driving unit 110 so as to move the mail 1 arranged on the conveyor belt 30 to any one of the first and second lateral regions of the crossbelt 10 adjacent to the destination outlet corresponding to the destination information, when the mail 1 arranged on the conveyor belt 30 is moved and arranged to and on the crossbelt 10 based on the destination information of the mail 1 inputted from the outside, during a manual mode operation according to a command inputted from the outside.

As described above, there is a difference in that the control unit 130 receives the destination information of the mail 1 by using the extraction unit 136 or the external device during the automatic or manual mode operation, and thereafter, a movement layout of the mail 1 may be the same as each other, but the present invention is not limited thereto.

In addition, the control unit 130 may control the mail 1 to be discharged to different outlets according to the length of the mail 1 among the destination outlets corresponding to the destination information.

That is, the control unit 130 discharges the mail 1 to the different outlets by classifying the mail 1 into a small size, a medium size, and a large size according to a length of a weight of the mail 1.

For example, in the mail sorting system 100, a principle of discharging the mail from the destination outlet according to the length of the mail 1 will be described.

That is, the control unit 130 makes a starting timing discharged from the destination outlet of the mail 1 arranged on the crossbelt 10 constant regardless of the length of the mail 1.

However, as the length of the mail 1 is larger, a time when the mail 1 falls from the crossbelt 10 to a place such as a pallet disposed at the destination outlet may be longer.

For example, when the mail 1 is arranged on any one of the first and second lateral regions of the crossbelt 10, the mail 1 having a length of 10 cm is discharged even when the crossbelt 10 moves only 5 cm. The mail 1 having a length of 80 cm is discharged when the crossbelt 10 needs to move 40 cm or more. A difference in driving distance of the crossbelt 10 between the two mails is 35 cm. When a speed of the crossbelt 10 is average 1.5 m/s, a time taken to discharge the mail 1 having the length of 10 cm is 33 ms, and a time taken to discharge the mail 1 having the length of 80 cm is 267 ms. In addition, when a track speed is 2.5 m/s, a difference in discharge point between the two mails is 58.5 cm. Accordingly, when the mail 1 is arranged on any one of the first and second lateral regions adjacent to the destination outlet, the outlets of the destination outlets are different from each other according to the length of the mail 1, and when the small-sized mail and the large-sized mail are separately discharged, it is possible to prevent the small-sized mail from being distorted or damaged.

As such, in the mail sorting system 100 of the exemplary embodiment, when the mail 1 is arranged on any one of the central region and the first and second lateral regions of the crossbelt 10 based on the length and the destination information of the mail 1, the mail 1 is easily discharged from the destination outlet, and when the mail 1 is discharged by classifying the mail 1 into the small, medium, and large sizes, or discharged in the order of the small, medium, and large sizes, it is possible to prevent the mail 1 from being damaged.

Figure 4:
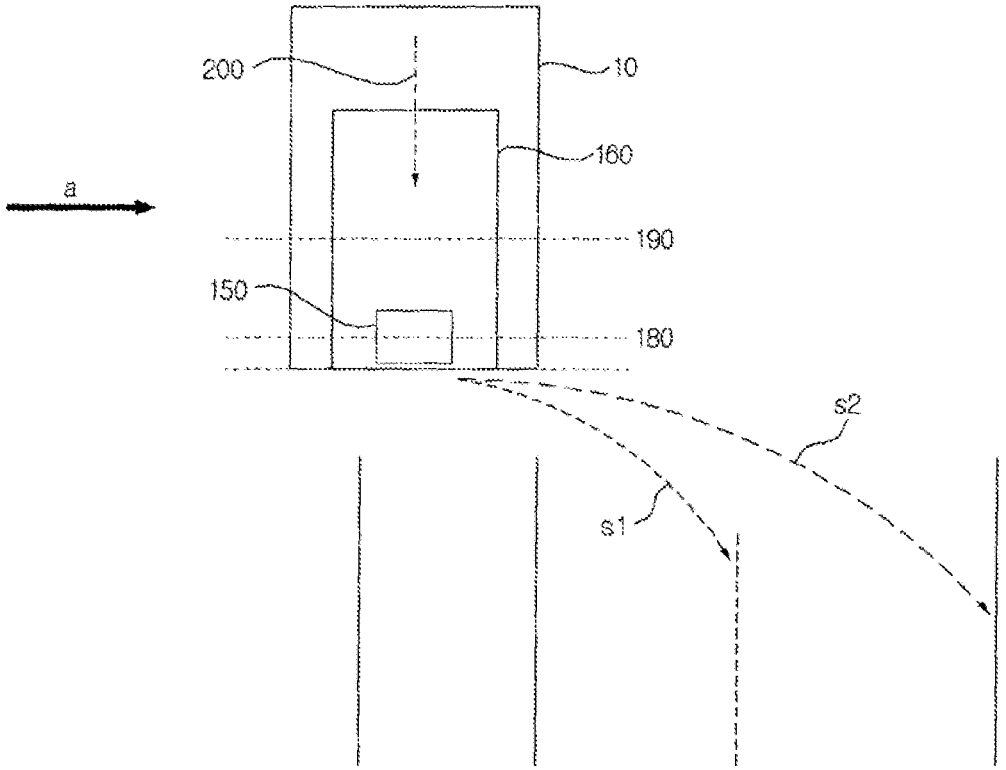
FIG. 4 is a diagram illustrating an example of discharging a mail in the mail sorting system according to the exemplary embodiment.
Figure 5:
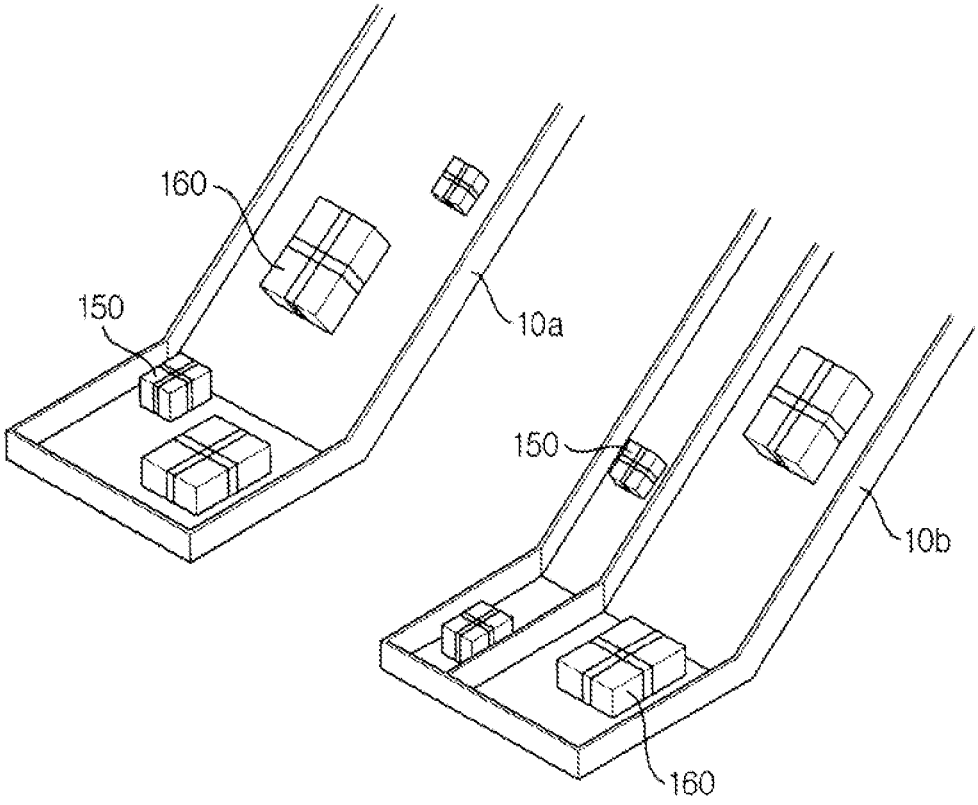
FIG. 5 is a diagram illustrating a destination outlet illustrated in FIG. 4.

FIG. 4 is a diagram illustrating an example in which a mail is discharged in the mail sorting system according to the exemplary embodiment, and FIG. 5 is a diagram illustrating a destination outlet illustrated in FIG. 4.

In FIG. 4, a discharge direction 200 of the destination outlet of the crossbelt 10 is a right side of a track heading direction a, and the mail 1 may be discharged when the crossbelt 10 moves by halves 180 and 190 in the lengths of a small-sized mail 150 and a large-sized mail 160 classified according to a length of the mail 1.

In this case, the small-sized mail 150 may be discharged first before the large-sized mail 160. Accordingly, the small-sized mail 150 may be discharged along a first trace s1 and the large-sized mail 160 may be discharged along a second trace s2.

In this case, in FIG. 5, since the small-sized mail 150 and the large-sized mail 160 are equally discharged and loaded at a destination outlet 10*a* in the related art, the damage or the deformation on the small-sized mail 150 may occur.

However, since the small-sized mail 150 and the large-sized mail 160 classified according to the length of the mail are separately loaded at a destination outlet 10*b* applied to the mail sorting system 100 according to the exemplary embodiment, the small-sized mail 150 may be prevented from being damaged.

Figure 6:
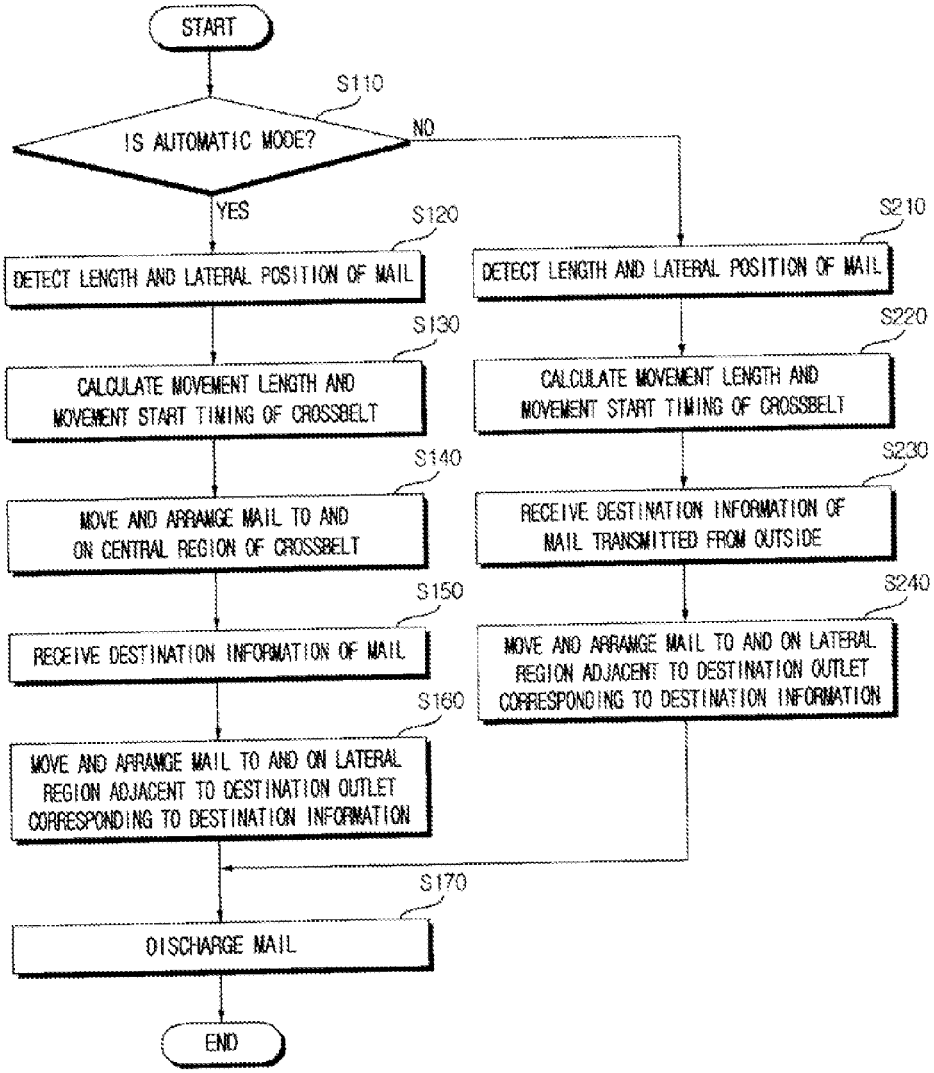
FIG. 6 is a flowchart illustrating an operation method of a mail sorting system according to another exemplary embodiment.

FIG. 6 is a flowchart illustrating an operation method of the mail sorting system according to the exemplary embodiment.

Referring to FIG. 6, the mail sorting system 100 may operate according to an input command for an automatic or manual mode operation from the outside.

The mail sorting system 100 determines the automatic mode operation or the manual mode operation (S100), detects at least one of a length and a lateral position of the mail 1 inserted to the conveyor belt 30 (S110), calculates a movement length and a movement starting timing of the crossbelt 10 based on at least one of the length and the lateral position of the mail 1 (S130), controls the mail 1 to be arranged on the central region of the crossbelt 10 based on the movement length and the movement starting timing of the crossbelt 10 (S140), receives destination information of the mail 1 (S150), controls the mail 1 to be moved and arranged to and on any one of the first and second lateral regions adjacent to the destination outlet corresponding to the destination information from the central region of the crossbelt 10 of the mail 1 (S160), and discharges the mail 1 from the destination outlet of the mail 1 (S170).

That is, the control unit 130 receives at least one detection signal of the length and the lateral position of the mail 1 inserted to the conveyor belt 30 from the detection unit 120, during the automatic mode operation.

In this case, the control unit 130 generates a motor control signal sc for controlling at least one of an rpm and a rotational speed of the motor m interworking with the crossbelt 10 and transmits the generated motor control signal sc to the crossbelt driving unit 110 so that the mail 1 is arranged on the central region of the crossbelt 10 in the automatic mode operation.

For example, in the case where the motor m makes one rotation, assuming that a driving distance of the crossbelt 10 is 20 mm, a length of the crossbelt 10 is 1,400 mm, and the length of the mail 1 is 500 mm, the motor control signal sc is generated and transmitted to the crossbelt driving unit 110 so that the driving distance of the crossbelt 10 is 950 mm when the mail 1 is moved and arranged to and on the crossbelt 10, and as a result, the mail 1 may be moved and arranged to and on the central region of the crossbelt 10.

In this case, the control unit 130 calculates a driving distance of the crossbelt 10 according to the length of the mail 1 through the following Equation 1 when the length of the crossbelt 10 is 1,400 mm.

[Equation 1]

$$y=0.5x+700 \quad (1)$$

$$b=y/a \quad (2)$$

In Equation 1, x represents a length of the mail 1, and y represents a driving length of the crossbelt 10. a represents a driving distance of the crossbelt 10 when the motor m of the crossbelt 10 makes a rotation, and b represents an rpm of the motor m included in the motor control signal sc transmitted by the control unit 130 to the crossbelt driving unit 110.

In this case, the crossbelt driving unit 110 operates the motor m interworking with the crossbelt 10 according to the motor control signal sc transmitted from the control unit 130 and thus the mail 1 may be arranged on the central region of the crossbelt 10.

Thereafter, the control unit 130 may determine a direction of the destination outlet corresponding to the destination information and generate a motor control signal sc and transmit the generated motor control signal so to the crossbelt driving unit 110 so that the mail 1 is moved and arranged to and on any one of the first and second lateral regions of the crossbelt 10 adjacent to the destination outlet, based on the destination information of the mail 1 extracted from the extraction unit 136.

For example, assuming that the length of the crossbelt 10 is 1,400 mm and the mail 1 is positioned on the central region of the crossbelt 10, the driving distance of the crossbelt 10 is calculated by the following Equation 2.

[Equation 2]

$$D=700-0.5C \quad (3)$$

$$b=D/a \quad (4)$$

C represents a length of the mail 1, and D represents a driving length of the crossbelt 10. a represents a driving distance of the crossbelt 10 when the motor m of the crossbelt 10 makes a rotation, and b represents a motor control signal sc including an rpm of the motor m of the crossbelt 10.

Thereafter, the crossbelt driving unit 110 moves the mail 1 arranged on the central region of the crossbelt 10 to any one lateral region adjacent to the destination outlet of the first and second lateral regions according to the motor control signal sc and then discharges the mail 1 to the destination outlet.

In step S110, when the manual mode operation is determined, the control unit 130 detects at least one of a length and a lateral position of the mail 1 inserted to the conveyor belt 30 (S210), calculates a movement length and a movement starting timing of the crossbelt 10 based on at least one of the length and the lateral position of the mail 1 (S220), receives destination information of the mail 1 (S230), controls the mail 1 to be moved and arranged to and on any one of the first and second lateral regions adjacent to the destination outlet corresponding to the destination information from the central region of the crossbelt 10 of the mail 1 (S240), and discharges the mail 1 from the destination outlet of the mail 1 (S170).

That is, the control unit 130 may extract the destination information before the mail 1 is inserted to the conveyor belt 30, during the manual mode operation.

In the exemplary embodiment, the automatic mode operation and the manual mode operation have different timings for extracting the destination information of the mail 1, and other operations may be the same as each other.

The mail sorting system according to the exemplary embodiment discharges the mail from the destination outlet to different outlets according to the length of the mail, and as a result, it is possible to prevent the small-sized mail from being damaged.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A mail sorting system comprising:

a detection unit configured to output a detection signal for a length of a mail inserted to a conveyor belt;

a crossbelt driving unit configured to control a motor interworking with a crossbelt including a central region and first and second lateral regions adjacent to both sides of the central region where the mail is moved and arranged from the conveyor belt; and a control unit configured to transmit to the crossbelt driving unit a motor control signal which controls at least one of a number of revolutions and a rotational speed of the motor so that the mail is arranged on one of the central region and the first and second lateral regions based on the detection signal and thereby discharged to a different destination outlet according to the length of the mail.

2. The mail sorting system of claim 1, wherein the detection unit includes a length measurement sensor which is arranged on one region of the conveyor belt and outputs the detection signal.

3. The mail sorting system of claim 1, wherein the detection signal is configured by a DC signal having a predetermined power level from a detection start timing of the mail up to a detection end timing.

4. The mail sorting system of claim 1, wherein the crossbelt driving unit includes:

a sensor configured to sense at least one of the rotational speed and the number of revolutions of the motor; and a motor driving unit configured to drive and control at least one of the rotational speed and the number of revolutions of the motor based on the motor control signal.

5. The mail sorting system of claim 4, wherein the motor driving unit receives the rotational speed and the number of revolutions sensed in the sensor to determine whether or not the motor operates in response to the motor control signal.

6. The mail sorting system of claim 1, wherein the detection signal is configured by a DC signal having a predetermined power level from a detection start timing of the mail up to a detection end timing, and the control unit calculates a length of the mail based on an elapsed time from the detection start timing to the detection end timing.

7. The mail sorting system of claim 6, wherein the control unit generates the motor control signal controlling at least one of the number of revolutions and the rotational speed of the motor corresponding to the length of the mail, based on a movement length of the crossbelt which is set according to the rotational speed and the number of revolutions of the motor.

8. The mail sorting system of claim 1, wherein the control unit includes a communication module configured to transmit the motor control signal to the crossbelt driving unit.

9. The mail sorting system of claim 1, wherein the control unit includes an extraction unit configured to extract the destination information of the mail inserted to the crossbelt, during an automatic mode.

10. The mail sorting system of claim 9, wherein the extraction unit is a reader which extracts a barcode or address information attached to the mail.

11. The mail sorting system of claim 9, wherein the control unit generates the motor control signal so that the mail is moved and arranged to and on the central region of the crossbelt, when the destination information is not inputted.

12. The mail sorting system of claim 11, wherein the control unit generates the motor control signal so that the mail is moved to the any one of the first and second lateral regions adjacent to the destination outlet corresponding to the destination information from the central region, when the destination information is inputted.

13. The mail sorting system of claim 1, wherein during a manual mode, the control unit generates the motor control signal so that the mail is moved to one of the first and second lateral regions which is adjacent to a destination outlet corresponding to destination information inputted from the outside.

14. The mail sorting system of claim 1, wherein when destination information is inputted, the control unit controls the mail to be discharged to a different outlet according to length of the mail among destination outlets corresponding to the destination information.

* * * * *